United States Patent [19]

Nagano et al.

[11] 4,286,932

[45] Sep. 1, 1981

[54] DIAPHRAGM PUMP

[75] Inventors: Shojiro Nagano; Naohiro Naganuma, both of Kariya; Mikiji Ito, Nagoya, all of Japan

[73] Assignee: Nippondenso Co., Ltd., Kariya, Japan

[21] Appl. No.: 9,803

[22] Filed: Feb. 6, 1979

[30] Foreign Application Priority Data

| | | | |
|---|---|---|---|
| Feb. 14, 1978 | [JP] | Japan | 53-17824[U] |
| Mar. 13, 1978 | [JP] | Japan | 53-31914[U] |
| Apr. 20, 1978 | [JP] | Japan | 53-53052[U] |
| Jun. 6, 1978 | [JP] | Japan | 53-68075 |

[51] Int. Cl.[3] ..... F04B 21/04

[52] U.S. Cl. ..... 417/526; 92/97; 92/100; 417/480; 417/534

[58] Field of Search ..... 417/526, 436, 480, 545, 417/413, 534; 92/100, 99, 98 R, 97, 48

[56] References Cited

U.S. PATENT DOCUMENTS

| | | | |
|---|---|---|---|
| 2,668,656 | 2/1954 | Booth, Jr. et al. | 417/534 |
| 3,208,394 | 9/1965 | Taplin | 417/534 |
| 3,238,889 | 3/1966 | Huber et al. | 417/534 |
| 3,335,641 | 8/1967 | Toschkoff | 92/100 |
| 3,849,026 | 11/1974 | Hartley | 417/536 |
| 4,086,036 | 4/1978 | Hagen et al. | 417/413 |

FOREIGN PATENT DOCUMENTS

| | | | |
|---|---|---|---|
| 2005339 | 9/1970 | Fed. Rep. of Germany | 417/526 |
| 479264 | 3/1953 | Italy | 417/480 |
| 580041 | 7/1958 | Italy | 417/526 |
| 627195 | 10/1961 | Italy | 417/534 |
| 491952 | 9/1938 | United Kingdom | 417/480 |
| 685143 | 12/1952 | United Kingdom | 417/480 |

*Primary Examiner*—Billy S. Taylor

*Attorney, Agent, or Firm*—Cushman, Darby & Cushman

[57] ABSTRACT

A diaphragm pump including an eccentric circular cam or crank shaft, a connecting rod rotatably connected at one end to the eccentric circular cam or crank shaft, a pair of diaphragms each having one surface serving as pressure receiving surface, center disks mounting the central portions of the pair of diaphragms on the opposite sides thereof, a first housing cooperating with one of the diaphragms and the center disks to define a first discharge chamber, a second housing cooperating with the other of the diaphragms and the center disks to define a second discharge chamber, a third housing cooperating with the pair of diaphragms and the center disks to define a suction chamber, a connecting member connecting the other end of the connecting rod to the center disks in the radial center and in the middle of the thickness thereof in order to minimize any swinging movement of the center disks which would otherwise be caused by reciprocatory swinging movement of the connecting rod, and guide means for guiding the center disks for preventing any swinging movement thereof.

20 Claims, 19 Drawing Figures

DIAPHRAGM PUMP

BACKGROUND OF THE INVENTION

This invention relates to diaphragm pumps, and more particularly to diaphragm pumps of the type suitable for use with engines for supplying secondary air thereto.

In one prior type of diaphragm pumps, movement of an eccentric cam on an engine is converted by a lever into reciprocatory movement which in turn is transmitted to a diaphragm of the pump through a shaft. This type of diaphragm pump is well known as fuel pump or vacuum pump. In this type of diaphragm pumps, the lever is urged at one end thereof against the eccentric cam by a spring and connected at the other end thereof to the shaft in such a manner that the lever exerts a one-way force on the shaft to push the latter either upwardly or downwardly, so that the diaphragm can be returned to its original position by the spring. When this type of diaphragm pump is used as fuel pump, the diaphragm is actuated by the spring in a discharge stroke to produce a predetermined discharge pressure of 0.2 to 0.3 kg/cm$^2$ and discharge a small amount of fuel. When this type of diaphragm pump is used as air pump for supplying secondary air to the engine, a return spring for diaphragm in a single-acting diaphragm pump should have a setting load sufficient to cause the pump to produce a discharge pressure of 0.5 to 0.6 kg/cm$^2$ and to deliver an amount of discharge ten times as much as the discharge of the fuel pump. Thus the force required for the drive lever to push or pull the shaft directly connected to the diaphragm is equal to or higher than the total pressure due to the discharge pressure plus the setting load of the return spring plus inertia. Therefore, the force for driving the driving lever is intermittent and very large to exert a high load on the engine. Also, a surface pressure produced between the diaphragm and the adjacent parts is large, resulting in reduced durability of diaphragm.

There have been proposed a double-acting type diaphragm pump having a large discharge at low revolution, being compact in size and having a single flat or pan-shaped diaphragm. In this type of diaphragm pump, the diaphragm moves repeatedly in the normal and reverse directions to produce noise, and is less durable. The maximum number of revolutions of the diaphragm pump is limited to about 2000 rpm., so that it is impossible to supply a required discharge of secondary air.

SUMMARY OF THE INVENTION

An object of this invention is to provide a diaphragm pump having a pair of diaphragms which do not turn over in operation.

Another object of this invention is to provide a diaphragm pump which dispenses with any return spring and can be operated by a low driving force.

Another object of this invention is to provide a diaphragm pump of compact size and of good durability.

A diaphragm pump according to the invention includes a pair of diaphragms which do not turn over in operation and is adapted to move directly receive reciprocating movement of the connecting rod. In this respect, the pump has the same discharge as that of a double-acting type diaphragm pump of the prior art, and includes diaphragms of improved durability, and dispenses with a spring to reduce a driving force by half. The diaphragm pump includes center disks supporting the two diaphragms at their centers and adapted to be moved by a connecting rod in reciprocatory movement. The diaphragm pump includes a unique connecting member for connecting the connecting rod to the center disks in such a manner that the torsional deflection produced in the diaphragms can be minimized. The connecting member is disposed in the radial center of the center disks, and arranged in the middle of the two diaphragms. The diaphragm pump further includes diaphragm guide means for guiding the center disks so as to prevent any swinging movement of the center disks which would otherwise be caused by the reciprocatory swinging motion of the connecting rod. The diaphragm pump is not limited in use to supplying secondary air to the engine, and can be driven by a motor or other prime mover.

PREFERRED EMBODIMENTS OF THE INVENTION

Figure 1:
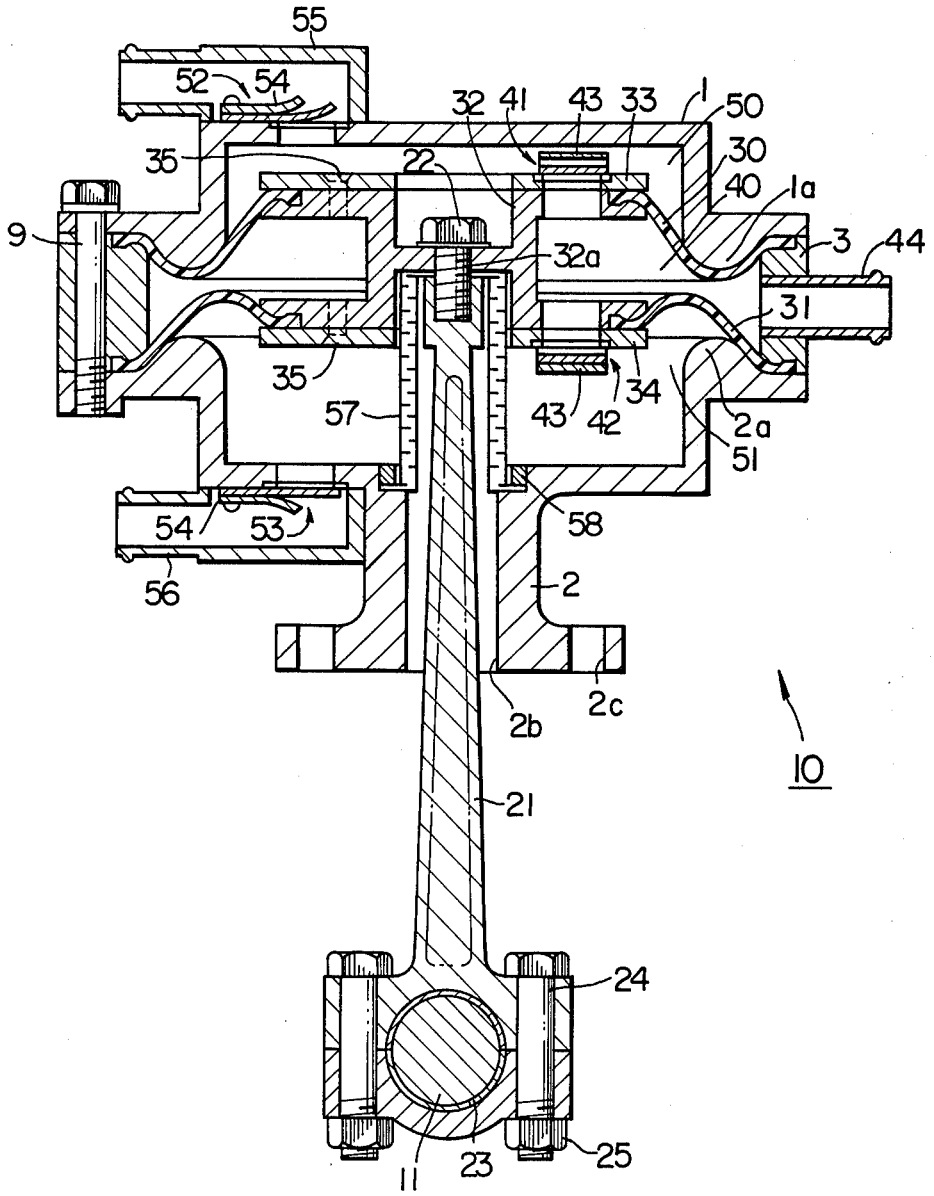
FIG. 1 is a sectional view of the diaphragm pump comprising a first embodiment of the invention.

Referring to FIG. 1, there is shown a diaphragm pump 10 according to a first embodiment of the invention, comprising housing means, drive means, movement transmitting means, diaphragm means, suction means and discharge means.

The housing means comprises first and second housings 1 and 2, and a third housing 3 fixedly interposed between the first and second housings 1 and 2 by means of a plurality of bolts 9. The first to third housings are formed of aluminium, but may be formed of a suitable synthetic resinous material having suitable strength and heat resistance. The first housing 1 is substantially pan-shaped in cross section and has a ring-shaped projection 1*a* which is brought into surface contact with a concave portion 30*a* of a diaphragm 30 subsequently to be described, when the latter is disposed in an axially uppermost position (FIG. 1). The second housing 2 includes a substantially pan-shaped portion similar to the first housing 1 and a flange portion. The pan-shaped portion has a ring-shaped projection 2*a* which is brought into surface contact with a concave portion 31*a* of a diaphragm 31 subsequently to be described, when the latter is disposed in an axially lowermost position (FIG. 1). The flange portion of the second housing 2 is formed with a bore 2*b*, through which a connecting rod 21, subsequently to be described, extend, the bore 2*b* having a diameter sufficient to allow the connecting rod 21 to move in swinging movement therein. The second housing 2 is further formed with openings 2*c* for attaching the second housing 2 and hence the diaphragm pump 10 to an engine, for example. The third housing 3 is substantially ring-shaped and mounts the diaphragms 30 and 31 thereto by means of bolts 9 with the diaphragms interposed between it and the first and second housings 1 and 2. The third housing 3 has connected thereto a suction pipe 44 which extends radially of the housing 3.

Figure 3:
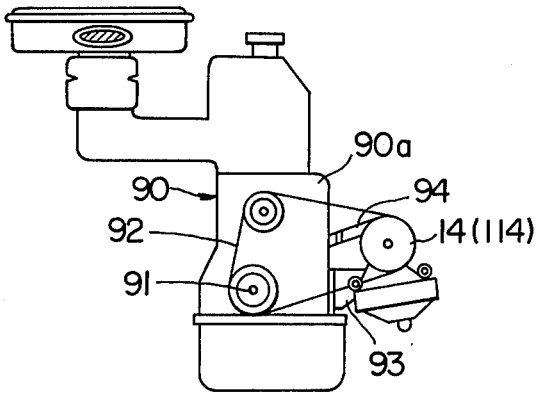
FIG. 3 is a side view of the diaphragm pump, shown as being attached to an engine.

The drive means comprises an eccentric circular cam or crank shaft 11, and a pulley 14 mounted at one end of the cam or crank shaft 11. As shown in FIG. 3, the pulley 14 is driven from a crank shaft 91 of an engine 90 by way of a belt 92. The eccentric circular cam or crank shaft 11 may be formed integrally with the crank shaft of the engine, or a crank mechanism may be provided on the main body of the diaphragm pump to drive the diaphragm pump by means of pulley.

The movement transmitting means comprises a connecting rod 21, and a bolt 22 for connecting the connecting rod 21 to a center disk 32 subsequently to be described. The lower end portion of the connecting rod 21 consists of two portions and is rotatably mounted on the eccentric circular cam or crank shaft 11 by means of bolts and nuts 24 and 25 through a metal or bearing 23. The upper end of the connecting rod 21 is formed with an internally threaded axial hole, and the bolt 22 extends through the bore 32*a* in the center disk 32 and is threadly fitted in the internally threaded hole in the connecting rod 21. Thus when the eccentric circular cam or crank shaft 11 rotates, the connecting rod 21 mounted thereon moves vertically and horizontally in swinging motion. However, since the bore 2*b* in the second housing 2 has a large diameter as aforesaid, the connecting rod 21 does not interfere with the second housing 2 in operation. Thus the connecting rod 21 is directly connected to the eccentric circular cam or crank shaft 11 to be driven thereby, and any return spring for the diaphragms is dispensed with to reduce a driving force of the pump by half, as compared with a prior cam-lever mechanism.

Figure 2:
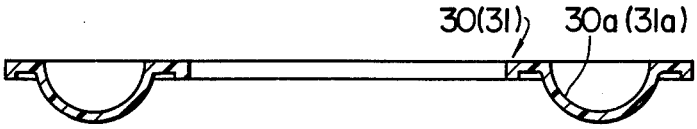
FIG. 2 is a sectional view of the diaphragm used in the diaphragm pump shown in FIG. 1, the diaphragm being shown in its free state.

The diaphragm means comprises a pair of ring-shaped diaphragms 30 and 31, a center disk 32 of an X-shaped cross section, and a pair of support plates 33 and 34. The diaphragms 30 and 31 have inner marginal portions interposed between the center disk 32 and the support plates 33 and 34, respectively, by screws 35, and outer marginal portions interposed between the third housing 3 and the first and second housings 1 and 2, respectively, by bolts 9. As shown in FIG. 2, the pair of diaphragms 30 and 31 each have a semicircular cross section in an unconstrained condition to increase the rigidity thereof. When assembled in position, the diaphragms 30 and 31 are disposed such that the concave pressure receiving surfaces 30*a* and 31*a* face the first and second housings 1 and 2, respectively, and are brought into surface contact with the projections 1*a* and 2*a* of the first and second housings 1 and 2, respectively, when the diaphragms 30 and 31 are in their respective uppermost and lowermost positions.

As described above, the diaphragms 30 and 31 have a semicircular cross section. However, the cross sections of the diaphragms 30 and 31 are not limited to this specific shape. The center disk 32 is formed of aluminium, but may be formed of a suitable synthetic resinous material having suitable strength and heat resistance. The center disk 32 is formed with an aperture 32*a* for connecting the connecting rod 21 to the center disk 32. The aperture 32*a* is formed in the central portion of the center disk 32 and in the middle of the thickness thereof, so that when the connecting rod 21 moves in reciprocatory swinging movement the diaphragms 30 and 31 move symmetrically in both vertical and horizontal directions. Thus the torsional deflection of the diaphragms 30 and 31 caused by the reciprocatory swinging movement thereof can be reduced to make the diaphragms durable. The diaphragms 30 and 31 have considerably high rigidity as aforesaid, so that any bush or cylinder can be dispensed with for preventing lateral deformation of the diaphragms which would otherwise be caused by the reciprocatory swinging movement of the connecting rod 21. Each of the diaphragms 30 and 31 has only one pressure receiving surface which is subjected to pressure in one direction. Thus the diaphragms do not turn over in operation and are advantageous both in noise control and durability. As shown in FIG. 1, the diaphragms 30 and 31 are connected to one end of the connecting rod 21 through the center disk 32, so that the diaphragm pump is reduced in its thickness to be small-sized.

The suction means comprises a suction pipe 44, a suction chamber 40 and suction valves 41 and 42. The suction pipe 44 is integrally force fitted in the third housing 3 to keep the suction chamber 40 in communication with an air cleaner (not shown) to cause the air filtered by the air cleaner to be introduced into the suction chamber 40. The suction chamber 40 is defined by the pair of diaphragms 30 and 31, center disk 32 and third housing 3 and is supplied with air through the suction pipe 44. The air introduced into the suction chamber 40 has the effect of cooling the pair of diaphragms 30 and 31. The suction valves 41 and 42 are mounted on the support plates 33 and 34, respectively and communicate with the suction chamber 40 through openings formed in the center disk 32 and support plates 33 and 34. Alternatively, the suction valves 41 and 42 may be mounted on the first and second housings 1 and 2, respectively. In this case, the suction chamber 40 should be open to the atmosphere to cool the diaphragms 30 and 31. Each of the suction valves 41 and 42 includes as valve seat a cushion 42 formed of a synthetic resinous material or rubber.

The discharge means comprises first and second discharge chambers 50 and 51, a pair of discharge valves 52 and 53, and a pair of discharge pipes 55 and 56. The first discharge chamber 50 is defined by the first housing 1, support plate 33 and diaphragm 30 to be supplied with air through the suction valve 41 and discharge the air through the discharge pipe 52. The second discharge chamber 51 is defined by the second housing 2, support plate 34, diaphragm 31 and a bellows 57 to be supplied with air through the suction valve 42 and discharge the air through the discharge valve 53. The discharge valve 52 is mounted on the first housing 1 and includes as valve seat a cushion 54 formed of a synthetic resinous material or rubber. The other discharge valve 53 is mounted on the second housing 2 and includes as valve seat cushion 54 formed of a synthetic resinous material or rubber. The discharge pipes 55 and 56 are attached to the first and second housings 1 and 2, respectively, and the air flows discharged from the exhaust pipes 55 and 56 are collected by way of a three-way pipe (not shown) and are delivered to the secondary air supply port of the exhaust pipe of the engine. A piece of bellows 57 has an inner diameter sufficient to allow the connecting rod 21 to move in swinging movement therein, and the upper end of the bellows is rigidly interposed between the center disk 32 and the connecting rod 21 by the bolt 22 and the lower end is mounted in a countersink of the second housing 2 by a ring 58. The bellows 57 thus isolates in airtight fashion the second discharge chamber 51 from the bore 2*b* formed in the second housing 2 and is capable of expanding and contracting axially thereof to permit the center disk 32 and the second housing 2 to move relative to each other. Also, the bellows 57 is highly resistant to radial deformations, so that even if the pressure in the second discharge chamber 51 exceeds a predetermined level, the bellow 57 is not displaced into contact with the connecting rod to interfere with its movement. The bellows 57 is formed of a hard resin, such as Teflon or nylon, which is resistant to heat, oil and gasoline. Thus the bellows 57 can withstand the heat transferred from the engine and a rise in temperature in the second discharge chamber and is impervious to blow-by gases contained in the air from the air cleaner. In this way, the bellows 57 permits the diaphragm pump to discharge air of high pressure and high temperature and thus serve as secondary air supply means for exhaust emission control for automotive vehicles. In FIG. 1, the first discharge chamber 50 is at the terminal of contraction stroke with the diaphragm 30 being in intimate contact with the projection 1*a* of the first housing 1, while the second discharge chamber 51 is at the terminal of expansion stroke with the diaphragm 31 being moved away from the projection 2*a* of the second housing 2. It will be seen that the difference between the maximum volume of expansion and the minimum volume of contraction in each discharge chamber is so large that the pumping efficiency of the diaphragm pump is greatly increased.

The diaphragm pump 10 constructed as aforesaid is mounted on a crank chamber housing 90*a* of the engine 90 through mounting members 93 and 94, as shown in FIG. 3. The driving force from the crank shaft 91 of the engine 90 is transmitted through the belt 92 to the pulley 14 attached to the end of the eccentric circular cam or crank shaft 11. A motor or other prime mover as well as engines of the automotive vehicle may be used as a drive source.

In operation, upon starting of the engine 90 the eccentric circular cam or crank shaft 11 is eccentrically rotated through the engine crank shaft 91, belt 92 and pulley 14. The connecting rod 21 directly connected to the eccentric circular cam or crank shaft 11 moves in reciprocatory swinging motion to cause the center disk 32 and diaphragms 30 and 31 to be reciprocated as a unit axially of the pump, thereby having the first and second discharge chambers 50 and 51 subjected to alternate expansion and contraction. During the upward movement of the center disk 32 in FIG. 1, the first discharge chamber 30 is in compression stroke in which the suction valve 41 is closed and the discharge valve 52 is opened, so that air is discharged from the first discharge chamber 50 through the discharge pipe 55. At this time, the second discharge chamber 51 is in expansion stroke, in which the discharge valve 53 is closed and the suction valve 42 is opened to introduce air into the second discharge chamber 51 through the suction pipe 44 and suction chamber 40. During downward movement of the center disk 32, the first discharge chamber 50 is in expansion stroke in which the discharge valve 52 is closed and the suction pipe 41 is opened to introduce air into the first discharge chamber 50 through the suction chamber 40. At this time, the second discharge chamber 51 is in compression stroke in which the suction valve 42 is closed and the discharge valve 53 is opened to discharge air from the second discharge chamber 51 through the discharge pipe 56.

During one reciprocatory movement of the center disk 32, each of the first and second discharge chambers 50 and 51 performs one suction operation and one discharge operation. Thus the diaphragm pump according to this invention has the same discharge capacity as that of a prior double-action type diaphragm pump, and is capable of delivering about twice as much discharge as that of a single-action type diaphragm pump. The invention enables the outer diameter of the diaphragms to be reduced by half as compared with a conventional diaphragm pump.

Figure 5:
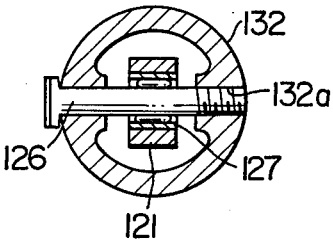
FIG. 5 is a sectional view of the cylindrical portion of the center disk, taken along the line IV—IV in FIG. 4.
Figure 6:
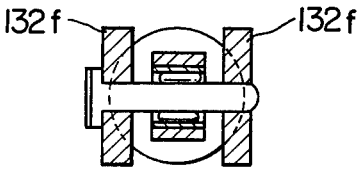
FIG. 6 is a sectional view similar to FIG. 5 but showing the plate-shaped connecting portion of the center disk distinct from the connecting portion shown in FIG. 5.
Figure 4:
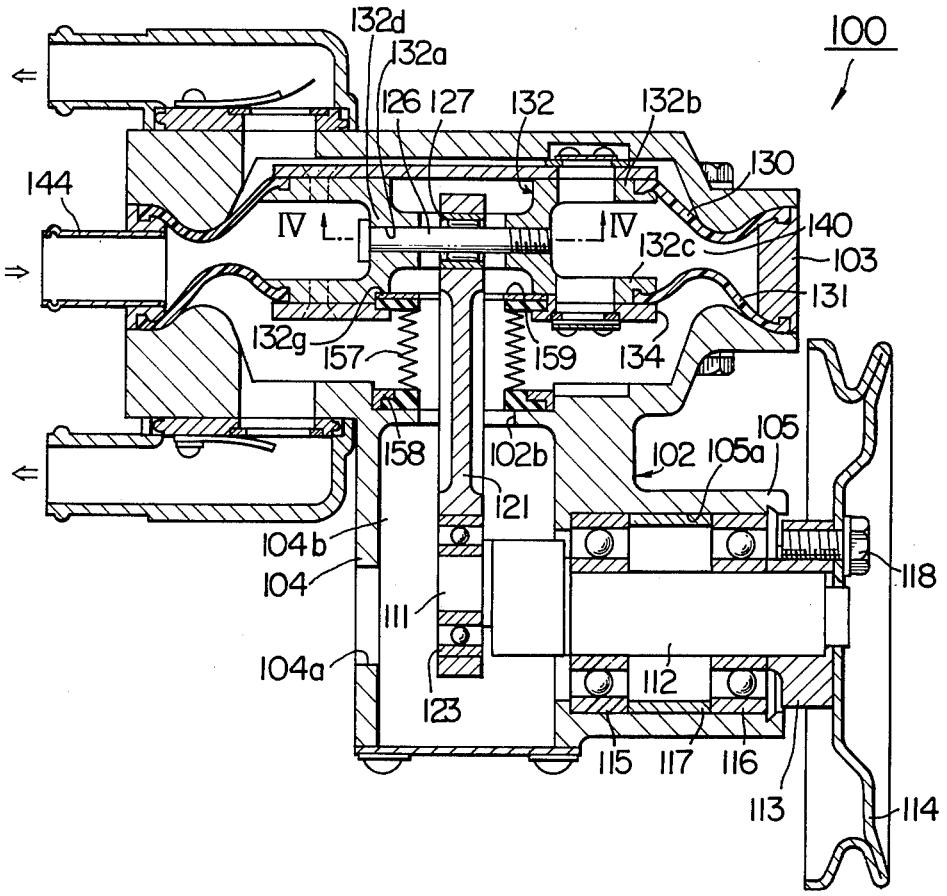
FIG. 4 is a sectional view of the diaphragm pump according to a second embodiment of the invention.

FIGS. 4 to 6 show a diaphragm pump 100 according to a second embodiment of the invention. In these figures, parts similar to those of the diaphragm pump 10 of the first embodiment will be designated by like reference characters. Therefore, only parts different from those of the diaphragm pump 10 will be described hereinbelow.

A second housing means 102 of the housing means includes a pan-shaped portion, a first sleeve portion 104 extending axially of the diaphragms 130 and 131, and a second sleeve portion 105 extending perpendicularly to the first sleeve portion 104. The first sleeve portion 104 is formed with a cylindrical cavity 104*b*, an aperture 102*b* and a window 104*a*. The second sleeve portion 105 is formed with a bore 105*a* for receiving therein drive means presently to be described.

The drive means comprises a drive shaft 112, an eccentric circular cam or crank shaft 111 formed integrally with the drive shaft 112, a hub 113 secured to the drive shaft 112 and a V-pulley 114 bolted to the hub 113 at 118. The drive shaft 112 is journalled by bearings 115 and 116 fitted in the bore 105*a* in the second sleeve portion 105 of the second housing 102, and a spacer 117 separates the bearings 115 and 116 from each other. The V-pulley 114 may be replaced by a pulley for timing belts for driving the drive shaft 112 from the engine (FIG. 3) through the timing belt. Also, the eccentric circular cam or crank shaft 111 may be directly connected to the cam shaft of the engine or the cam of the crank shaft 91 or a crank by remodelling the engine 90. However, in case the eccentric circular cam or crank shaft 111 is directly connected to the cam shaft, care should be taken of the fact that the number of revolutions of the cam shaft will be one half the number of revolutions of the engine 90.

The movement transmitting means comprises a connecting rod 121, a bearing 123 for rotatable connection of the lower end of the connecting rod 121 to the eccentric circular cam or crank shaft 111, and a support shaft 126 for connection of the upper end of the connecting rod 121 to a center disk 132 subsequently to be described. The window 104*a* in the first sleeve portion 104 of the second housing 102 is disposed in substantially facing relation with the bearing 123 to permit the bearing 123 to be cooled by the atmosphere. The connecting rod 121 is pivotally mounted at its upper end on the support shaft 126 through a bearing 127, such as a needle bearing or oilless metal. The bearing 127 may be a ball bearing, but this type of bearing has the disadvantage of being large in outer diameter. The bearing 127 reduces the swinging movement of the connecting rod 121 transmitted to the diaphragm means through the support shaft 126, thereby realizing a reduction in the length of the connecting rod 121 as compared with the length of the connecting rod 21 of the first embodiment (FIG. 1) and advantageously making a diaphragm pump 100 small-sized.

A center disk 132 of the diaphragm means includes a pair of ring-shaped portions 132*b* and 132*c*, and a substantially cylindrical portion 132*d* (FIG. 5) for connecting the ring-shaped portions 132*b* and 132*c* together in a unitary structure. The cylindrical portion 132*d* is concentric with the ring-shaped portions 132*b* and 132*c*, and is formed at the middle of its height with a diametrically extending hole 132*a*. One end portion of the hole 132*a* is internally threaded to be threadably fitted on the support shaft 126. In this way, the support shaft 126 of the movement transmitting means extends diametrically through the cylindrical portion 132*d* of the center disk 132 at the middle of its height, and the upper end of the connecting rod 121 is connected in the center of the cylindrical portion 132*d* to the support shaft 126 through the bearing 127. Therefore, slanting of the connecting rod 121 with respect to the axis of the diaphragms which is caused by the eccentric rotation of the eccentric circular cam or crank shaft 111 is not directly transmitted to the center disk 132 with the result that the reciprocatory swinging movement of the diaphragms 130 and 131 becomes smaller than that of the diaphragms 30 and 31 of the first embodiment (FIG. 1) in which the connecting rod 21 is rigidly connected to the center disk 32 by the bolt 22. As a result, lateral displacement of the diaphragms 130 and 131 is much smaller than axial displacement thereof, so that torsional deflection of the diaphragms 130 and 131 can be reduced. This realizes a reduction in the length of the connecting rod 121, thereby making a diaphragm pump small-sized. Since the diaphragms 130 and 131 are actuated by the connecting rod 121 through the bearing 127, their operation is well balanced and smooth at high speed to improve durability of the diaphragms. It is to be understood that pumping action can be obtained even if the cylindrical portion 132*d* of the center disk 132 were not concentric with the ring-shaped portions 132*b* and 132*c* or the support shaft 126 were connected to the cylindrical portion 132*d* in other position than the middle of the height of the portion 132*d*.

As seen in FIG. 4, the suction pipe 144 is secured to the third housing 103. Alternatively, the suction pipe 144 may be attached to the window 104*a* of the second housing 102 and the cylindrical portion 132*d* of the center disk 132 may be replaced by a pair of plate members 132*f*, as shown in FIG. 6, without interfering with air flow to the suction chamber 140. In this case, air flow from the suction pipe 144 to the suction chamber 140 serves to cool the bearings 123 and 127 at the upper and lower ends of the connecting rod 121. Also, two suction pipes 144 may be used for attachment to the window 104*a* of the second housing 102 and the third housing 103, respectively. In the event that the diaphragm pump according to the invention is used in other applications than the supply of secondary air to the engine of an automotive vehicle, air is not required to filter through any air cleaner before being introduced into the diaphragm pump.

Referring to FIG. 4 again, the upper end of the bellows 157 is securedly interposed in a counter sink 132*g* of the center disk 132 between protecting and support plates 159 and 134, and the lower end portion thereof is secured in a countersink of the second housing 102 by force fitting a ring 158 in the countersink.

FIGS. 7 to 12 show a diaphragm pump 200 according to a third embodiment of the invention. In the drawings, parts similar to those of the first embodiment shown in FIGS. 1 to 3 and to the second embodiment shown in FIGS. 4 to 6 are designated by like reference characters. Therefore, only parts different from those of the diaphragm pump 100 of the second embodiment will be described hereinbelow.

Figure 7:
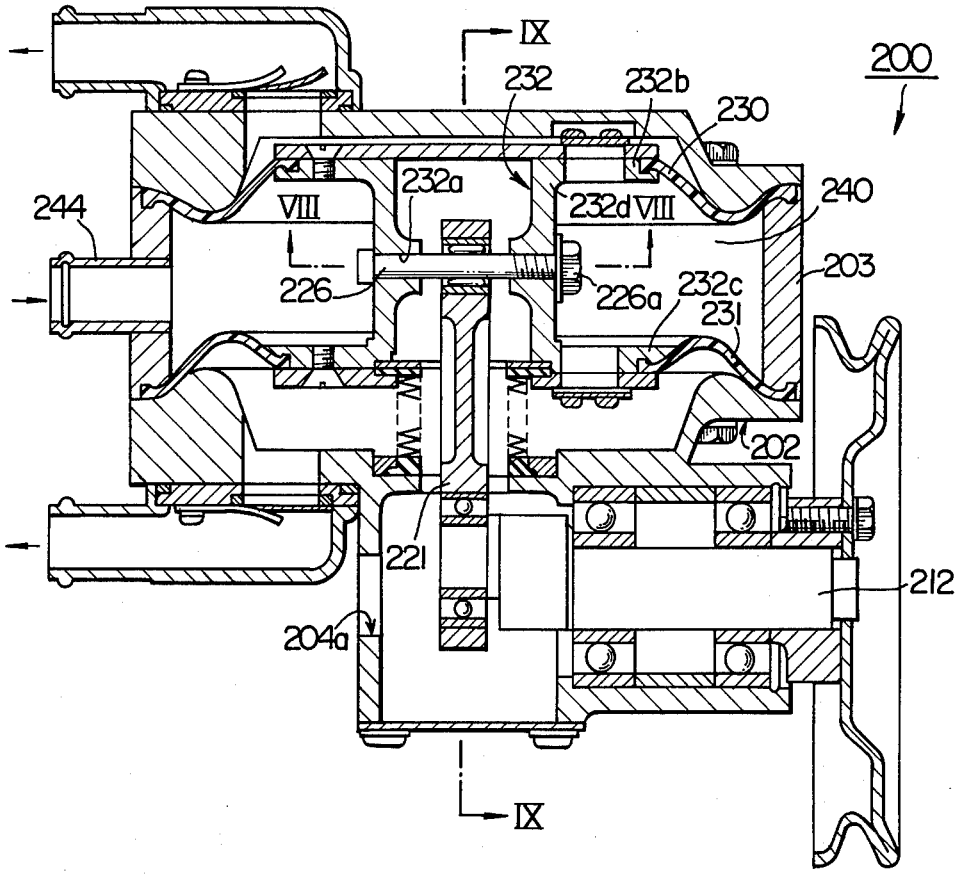
FIG. 7 is a sectional view of the diaphragm pump according to a third embodiment of the invention.
Figure 8:
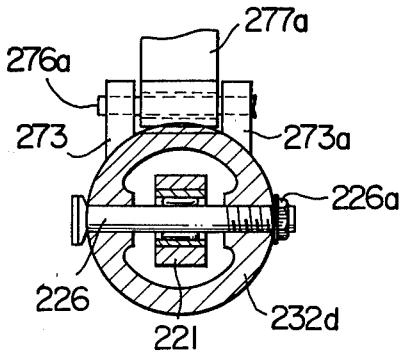
FIG. 8 is a sectional view of the cylindrical portion of the center disk, taken along the line VIII—VIII in FIG. 7.
Figure 11:
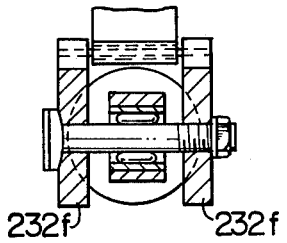
FIG. 11 is a sectional view of the plate-shaped connecting portion of the center disk.

Referring to FIGS. 7, 8 and 11, there is shown a center disk 232 formed with an aperture 232*a* which, unlike the hole 132*a* in the center disk 132 shown in FIG. 4, is a through hole, and a support shaft 226 is secured to a connecting portion 232*d* of the center disk 232 by a nut 226*a*.

Figure 9:
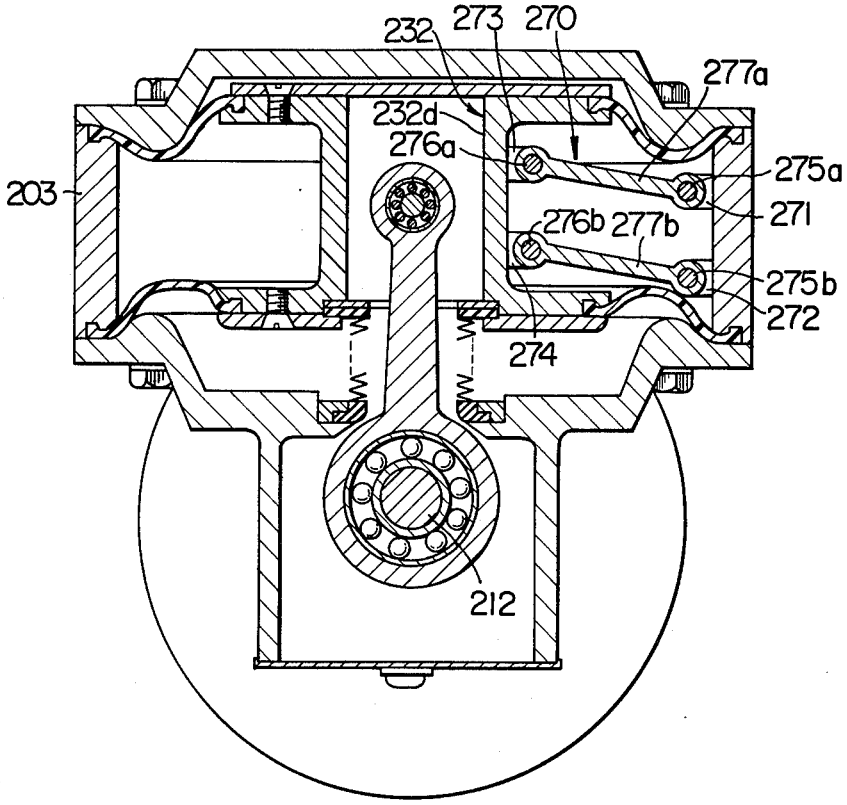
FIG. 9 is a sectional view of the diaphragm pump taken along the line IX—IX in FIG. 7.

Referring to FIG. 9, diaphragm guide means 270 comprises two pairs of projections 271 and 272 secured to an inner wall surface of the third housing 203, two pairs of projections 273 and 274 secured to the connecting portion 232*d* of the center disk 232, two pairs of stub shafts 275*a*, 275*b* and 276*a*, 276*b* extending parallel to a drive shaft 212, and a pair of levers 277*a* and 277*b* pivotally connected at their opposite ends to the stub shafts 275*a*, 275*b*, 276*a* and 276*b*. The stub shaft 275*a* is secured by force fit or calking in openings formed in the projections 271*a* and 271*b* on the wall of the third housing 303, and the stub shaft 275*b* is secured in like manner in openings formed in the projections 272*a* and 272*b* on the wall of the third housing 303. The stub shaft 276*a* is secured by force fit or calking in openings formed in the projections 273*a* and 273*b* on the connecting portion 232*d* of the center disk 232, and the stub shaft 276*b* is secured in like manner in openings formed in the projections 274*a* and 274*b* on the connecting portion 232*d*. As seen from FIG. 10, the levers 277*a* and 277*b* are in the form of thick plate formed of a light metal and being of the same length and each lever is provided at opposite ends thereof with metal portions 278. Each of the metal portions 278 are fitted with a tubular metal 279, such as a Teflon bush or oilless metal bush, and the levers 277*a* and 277*b* are pivotally mounted on the stub shafts 275*a*, 275*b*, 276*a* and 276*b* through the tubular metals 279.

Figure 12:
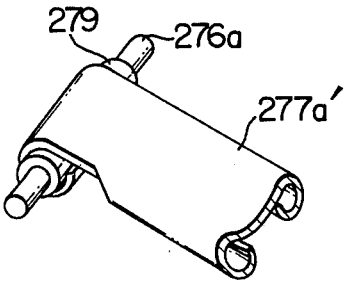
FIG. 12 is a perspective view of a modification of the lever with certain parts being broken away.

Alternatively, the levers 277*a* and 277*b* may be formed of steel sheet by bending opposite end portions thereof so as to wind round the tubular metal 279 and by bending the longitudinal opposite edges thereof in accurate form so as to increase strength. The lever 277*a*', shown in FIG. 12, is exemplary of such construction.

Figure 10:
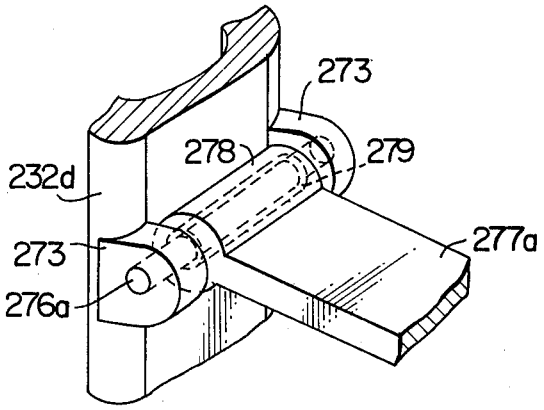
FIG. 10 is a perspective view of the diaphragm guide means with certain parts being broken away.

As shown in FIG. 9, the spacing between the pairs of projections 271*a*, 271*b* and 272*a*, 272*b* on the third housing 203 is equal to the spacing between the pairs of projections 273*a*, 273*b* and 274*a*, 274*b* on the connecting portion 232*d* of the center disk 232, so that the stub shafts 275*a*, 275*b*, 276*a* and 276*b* form a parallerogram in cross section. In this way, the levers 277*a* and 277*b* constitute a parallel motion mechanism to cause the center disk 232 to reciprocatingly move in parallel with the axis of the third housing 203. The pairs of projections 271*a*, 271*b* and 272*a*, 272*b* on the third housing 203 and the pairs of projections 273*a*, 273*b* and 274*a*, 274*b* on the connecting portion of the center disk 232 are positioned such that when the center disk 232 moves between its uppermost and lowermost positions, the levers 277*a* and 277*b* do not interfere with the diaphragms 230 and 231, respectively. In this respect, so long as the stub shafts 275*a*, 275*b*, 276*a* and 276*b* form a parallelogram in cross section, the pair of levers 277*a* and 277*b* may be arcuate in cross section so as not to interfere with the diaphragms 230 and 231. In FIGS. 9 and 10, the two pairs of projections 273*a*, 273*b* and 274*a*, 274*b* are secured to the connecting portion 232*d* of the center disk 232. However, the projections may be secured to inner surfaces of ring-shaped portions 232*b* and 232*c* of the center disk 232 provided that the levers 277*a* and 277*b* do not interfere with the diaphragms 230 and 231. Alternatively, the pairs of projections 273*a*, 273*b* and 274*a*, 274*b* may be secured to the connecting portion of the center disk in positions disposed in a plane extending through the axis of the support shaft 226 and the axis of the center disk 232, or they may be secured to the connecting portion 232*d* or the inner surfaces of the ring-shaped portions 232*b* and 232*c* of the center disk 232 in positions opposite the projections 271*a*, 271*b*, 272*a* and 272*b* on the third housing 203 with respect to the axis of the center disk 232. In this case, so long as the levers do not interfere with the diaphragms 230 and 231 the levers may be modified in shape to become longer than those shown in FIG. 9, so that the center disk 232 would be subject to less horizontal displacement when moving in parallel motion, thereby minimizing the distortion of the diaphragms 230 and 231.

Referring to FIG. 7, the suction pipe 244 is attached to the third housing 203. Alternatively, it may be attached to the window 204*a* in the second housing 202. In this case, the connecting portion 232*d* of the center disk 232 may be in the form of two plates as shown in FIG. 11 to introduce air into the suction chamber 240 through the suction pipe 244 secured to the window 204*a*.

The diaphragm pump 200 shown in FIGS. 7 to 12 and according to the third embodiment of the invention operates as follows. When the center disk 232 is subject to a force slanting to the axis thereof from the connecting rod 221, the center disk 232 moves in reciprocatory motion in such a manner that the axis of the center disk is maintained parallel to the axis of the third housing 203 by virtue of the parallel motion mechanism of the diaphragm guide means 270. As a result, the diaphragms 230 and 231 are slightly displaced in the horizontal direction. In case the levers 277*a* and 277*b* have a length of 25 mm and the center disk 232 reciprocates vertically a stroke of 12 mm, the maximum value of the horizontal displacement of the diaphragm 230 and 231 is about 0.73 mm which makes the torsional deflection of the diaphragms quite small. Therefore, the length of the connecting rod 221 can be reduced as compared with that of the connecting rod 121, thereby a diaphragm pump small-sized.

FIGS. 13 to 19 show a diaphragm pump 300 according to a fourth embodiment of the invention. In the figures, parts similar to those shown in FIGS. 1 to 12 are designated by like reference characters. Accordingly, only those parts different from the parts in FIGS. 1 to 12 will be described hereinbelow.

Figure 13:
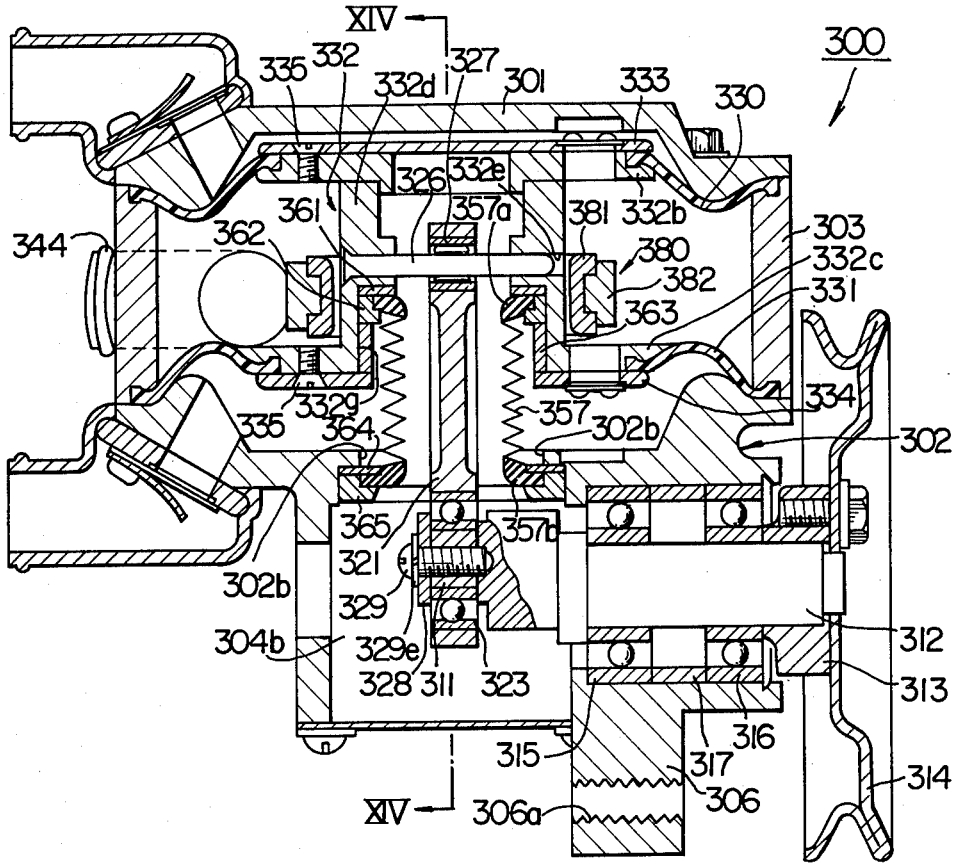
FIG. 13 is a sectional view of the diaphragm pump according to a fourth embodiment of the invention.
Figure 14:
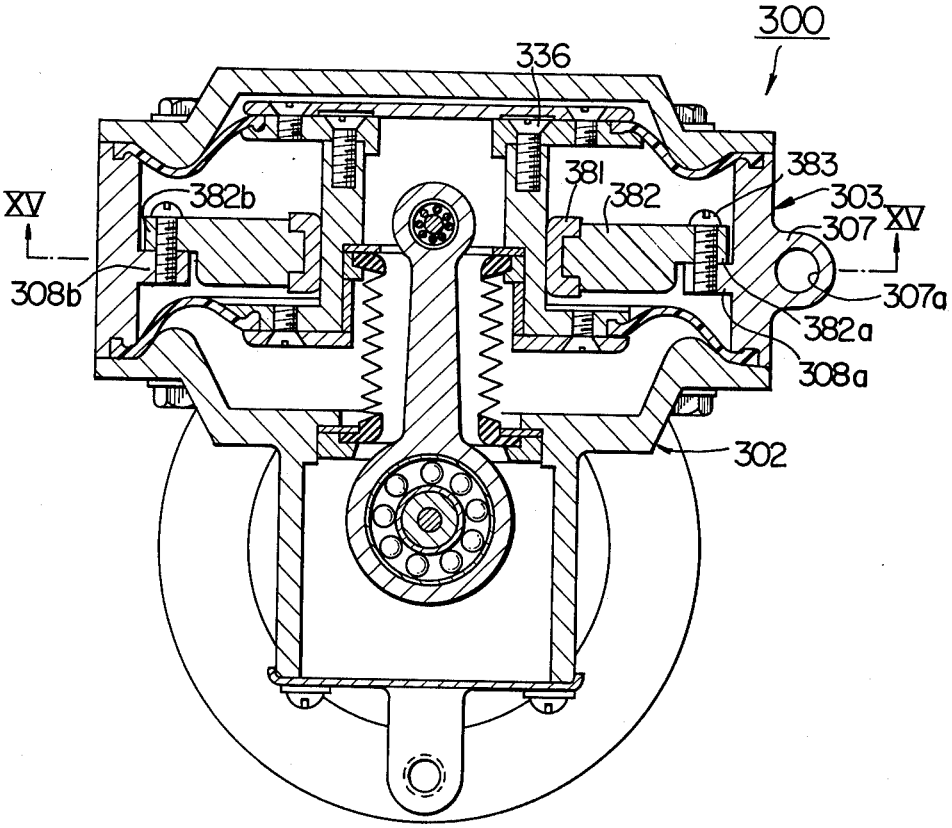
FIG. 14 is a sectional view taken along the line XIV—XIV in FIG. 13.
Figure 15:
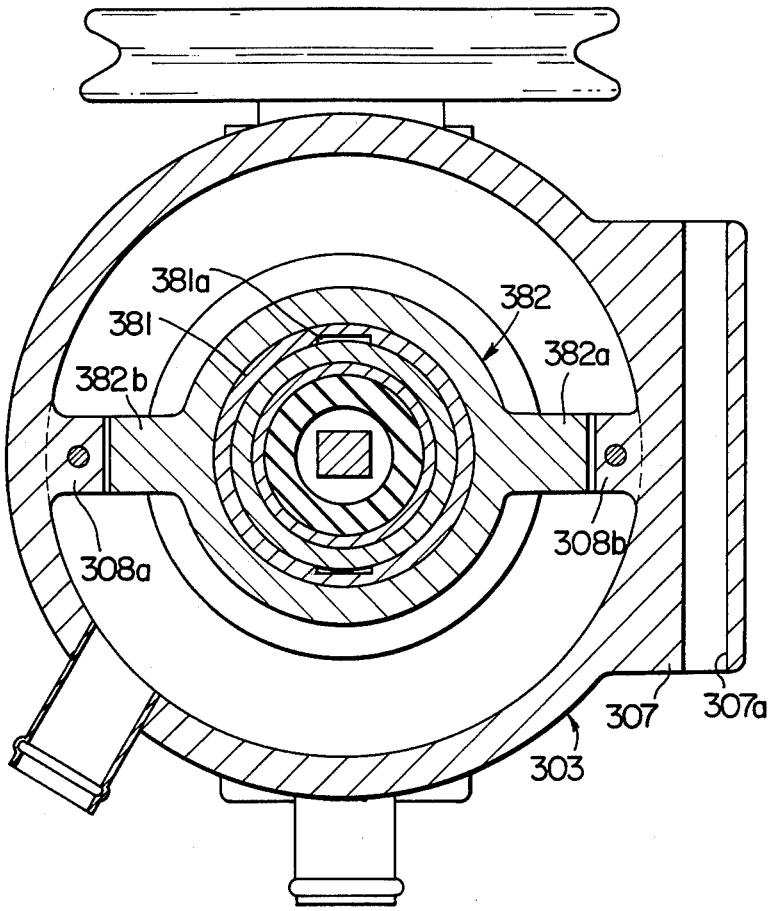
FIG. 15 is a sectional view of the diaphragm pump taken along the line XV—XV in FIG. 14.

Referring to FIG. 13, a second housing 302 includes a boss 306 formed with an internally threaded bore 306*a* for adjustment of the drive belt 92 (See FIG. 3). Referring to FIGS. 14 and 15, a third housing 303 includes a boss 307 formed with a bore 307*a* for reception of a through bolt for securing the diaphragm pump 300 to the mounting member 93 of the engine 90 (See FIG. 3).

In FIG. 13, the connecting rod 321 is journalled at its lower end in a bearing 323 which is secured to the eccentric circular cam or crank shaft 311 by using a stopper 328, a washer 329*e* and a screw 329. By this arrangement, the bearing 323 is prevented from being detached from the crank shaft 311 when the diaphragm pump 300 operates at high speed. The support shaft 326 includes a rod-shaped portion and a pan-shaped head, and is secured in an opening 332*e* in the connecting portion 332*d* of the center disk 332 by screws or calking, so that the shaft 326 will not project from the surface of the connecting portion 332*d*.

Figure 17:
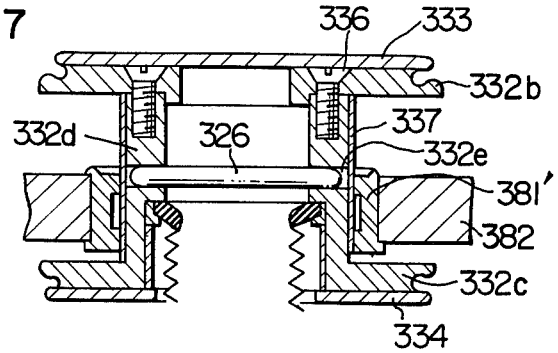
Figure 18:
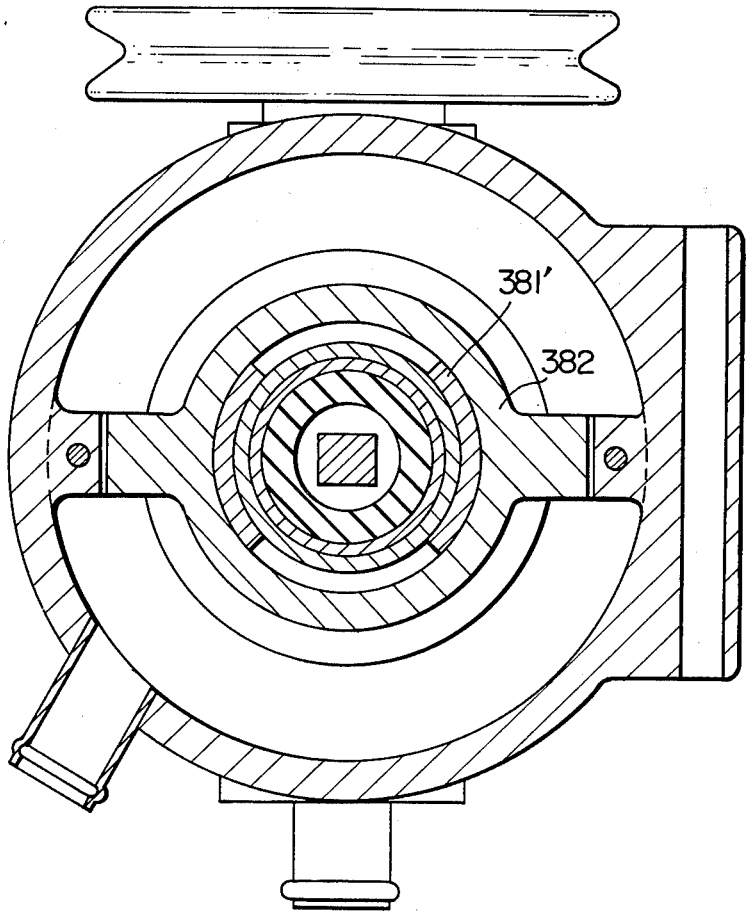
FIGS. 18 and 19 are sectional views of the diaphragm guide means similar to the diaphragm guide means shown in FIG. 15, but showing a modification thereof.

Referring to FIGS. 13 and 14, the center disk 332 includes ring-shaped portions 332*b* and 332*c* as well as the connecting portion 332*d* formed integrally at one end portion thereof with one ring-shaped portion 332*c*. The other end portion thereof of the connecting portion 332*d* is connected to the other ring-shaped portion 332*b* by a screw 336 to form a socket and spigot joint. As shown in FIG. 13, the connecting portion 332*d* of the center disk 332 is formed in the middle of its height with a diametrically extending opening 332*d* which opening is countersunk at one end thereof. Alternatively, the connecting portion 332*d* of the center disk 332 may be fitted in a thin pipe 337 of high abrasion resistance, and formed as of stainless steel, as shown in FIG. 17. In this case, the thin pipe 337 can be fitted over the connecting portion 332*d* after the support shaft 326 is fitted in the opening 332*e* in the connecting portion 332*d*, so that there is no need of any countersink at one end of the opening 332*e* and of screwing or calking for securing the support shaft 326 in the opening 332*e*. As shown, the connecting portion 332*d* of the center disk 332 is cylindrical in shape but may be polygonal in cross section or may be in the form of two plates.

Referring to FIGS. 13 to 15, the diaphragm guide means 380 includes a ring-shaped slide member 381 formed of a lubricating material, such as oilless metal or Teflon, and a support member 382 for holding the slide member 381. The support member 382 includes a ring-shaped portion and two arms 382*a* and 382*b* diametrically extending from the ring-shaped portion. The guide means 380 is positioned concentrically with the third housing 303 by securing the arms 382*a* and 382*b* by screws 383 to projections 308*a* and 308*b* on the inner wall surface of the third housing 303. As shown in FIG. 13, the slide member 381 has a diameter slightly larger than the outer diameter of the connecting portion 323*d* of the center disk 332 to allow the connecting portion 332*d* to move smoothly in sliding motion, and is preferably formed with grooves 381*a*, as shown in FIGS. 13 and 15, which grooves are disposed in facing relation to the opening 332*e* in the connecting portion 332*d* so as to avoid the interference of the edges of the opening 332*e* with the inner wall surface of the slide member 381.

Figure 16:
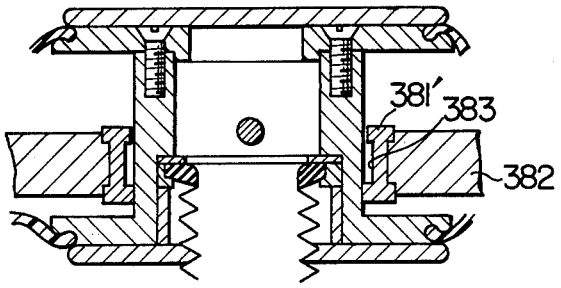
FIGS. 16 and 17 are sectional views of modifications of the center disk and the sliding member.
Figure 19:
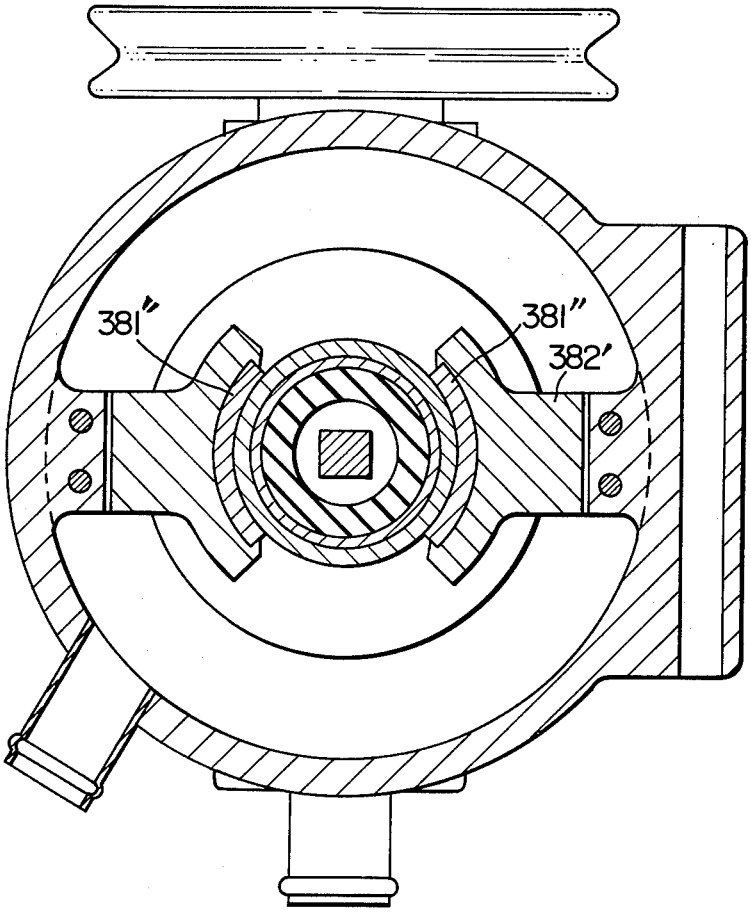

In FIGS. 16 and 17, the slide member 381' is formed with a circumferentially extending groove 383 on the inner wall surface thereof to reduce the resistance given to the connecting portion 332*d* of the center disk 332 as by grease or other lubricant contained in the groove 383. As seen from FIG. 13, the swinging movement of the center disk 332 driven by the connecting rod 321 occurs about the axis of the support shaft 326. Thus the slide member of the guide means 380 may be in the form of a pair of arcuate members (FIG. 18) arranged on opposite sides of the support shaft 326. In this case, the sliding resistance given to the slide member of the guide means 380 is further reduced. Also, the support member 382' may, as shown in FIG. 19, include a pair of arcuate portions and a pair of arms, which arcuate portions hold the arcuate slide member 381''. In this case, each arm of the support member 382' can secure the support member in accurate position to projections 309*a* and 309*b* on the third housing 303 by using knock pins or more than two reamer bolts. When the support member consisted of two members, the ring-shaped portions 332*b* and 332*c* of the center disk 332 may be integral with the connecting portion 332*d*. If the connecting portion of the center disk 332 is in the form of cylinder of a polygonal cross section or two plates, then it will be necessary for the slide member to have flat sliding surfaces.

Referring to FIGS. 13 and 14, there is shown a bellows 357 of which an upper end portion 357*a* is held between a washer 361 and a cap ring 362 in a counterbore 332*g* formed in the connecting portion 332*d* of the center disk 332 and is secured to the center disk 332 by fastening a tubular member 363 to a support plate 334 by screws 335. A lower end portion 357*b* of the bellows is held between a split washer 364 and a cap ring 365 is a counter-bore formed in the second housing 302 and is secured to the inner wall surface of the second housing 302 by caulking.

The diaphragm pump 300 of the aforesaid construction is assembled as follows. First, the upper end portion 357*a* of the bellows 357 is secured to the connecting portion 332*d* of the center disk 332 by using the washer 361, cap ring 362, tubular member 363, and support plate 334. At this time, the lower diaphragm 331 is secured in place between the center disk 332 and support plate 334 by the screws 335. Thereafter the connecting rod 321 having bearings 323 and 327 fitted therein is inserted through the bellows 357, and the support shaft 326 is inserted through the opening 332*e* in the connecting portion 332*d* of the center disk 332 and the bearing 327 in the connecting rod 321, thereby pivotally mounting the connecting rod 321 to the center disk 332. After the arms 382*a* and 382*b* of the support member 382 provided with the slide member 381 are secured to the third housing 303 by the screws 383, the center disk 332 which have the connecting rod 321 and the lower diaphragm 310 mounted thereon is placed on the second housing 302 with the lower end portion of the bellows 357 depending into a cavity 304*b* in the second housing 302. Then the third housing 303 is placed on the second housing 302 with the lower diaphragm 331 therebetween while the slide member 381 is fitted over the connecting portion 332*d* of the center disk 332. Thereafter the upper ring-shaped portion 332*b* of the center disk 332 is secured to the connecting portion 332*d* by the screws 335, and then the upper diaphragm 330 is placed on the ring-shaped portion 332*b* and the third housing 303 with its inner marginal portion being held between the support plate 333 and the ring-shaped portion 332*b* by the screws 335. Then the first housing 301 is placed on the third housing 303 with the upper diaphragm 330 held therebetween, and the first, second and third housings 301, 302 and 303 are bolted together. Then the split washer 364 is force fitted in the counter-bore in an opening 302*b* in the second housing 302, and then the cap ring 365 is fitted in the counter-bore with the lower end portion 357*b* of the bellows 357 held between the cap ring 365 and the washer 364. By caulking the edge of the counter-bore, the lower end portion 357*b* of the bellows 357 is secured to the second housing 302. While the lower end portion of the connecting rod 321 depending in the cavity 304*b* in the second housing 302 is held by a suitable jig, the crank 311 of the drive shaft 312 is fitted in the bearing 323 at the lower end of the connecting rod 321. Finally the bearings 315 and 316 and spacer 317 are fitted over the drive shaft 312, and the hub 313 and pulley 314 are secured to the drive shaft 312.

In operation, the connecting portion 332*d* of the center disk 332 is guided by the slide member 381 of the diaphragm guide means 380, so that when driven by the connecting rod 321, the swinging movement of the center disk 332 around the support shaft 326 can be prevented. Thus the center disk 332 is reciprocatingly moved in the axial direction and causes no torsional deflection to the diaphragms 330 and 331, thereby improving their durability.

While preferred embodiments of the invention have been shown and described hereinabove, it is to be understood that various modifications and changes may be made without departing from the scope of the invention.

What is claimed is:

1. A diaphragm pump comprising:

a pair of generally annular diaphragms;

center disk means having the inner marginal portions of said diaphragms secured thereto and maintaining said diaphragms in spaced relation;

housing means enclosing said diaphragms and disk means and having the outer marginal portions of said diaphragms secured thereto, said housing means defining, with said diaphragms and said disk means, a pair of pumping chambers on opposite sides of said disk means for alternately receiving fluid from outside said housing means through housing means intake port means and alternately compressing the fluid and discharging it to outside said housing means through housing means discharge port means;

suction valve means and discharge valve means for each of said chambers;

connecting rod means extending into said housing means and having one end thereof attached to said disk means and the other end thereof adapted to be attached to rotating drive means for reciprocating said disk means and said diaphragms substantially axially thereof; and bellows means surrounding a portion of said connecting rod means and having one end thereof sealed to said disk means and the other end thereof to said housing means and defining a part of the wall of one of said pumping chambers.

2. A diaphragm pump as set forth in claim 1 wherein said connecting rod is connected to said center disk means in the radial center thereof and centrally between said pair of diaphragms, a suction chamber is defined between said diaphragms and the suction valve means are mounted to said center disk means.

3. A diaphragm pump as set forth in claim 1 wherein each of said pair of diaphragms has a pressure receiving surface facing one of said pair of pumping chambers, said pressure receiving surface being formed with an annular concave portion.

4. A diaphragm pump as set forth in claim 3 wherein said housing means is formed at portions of the inner surface thereof with annular convex portions, each of said annular convex portions being adapted to be brought into surface contact with one of said annular concave portions of said pair of diaphragms when said diaphragms come closest to the housing means in reciprocatory movement.

5. A diaphragm pump as set forth in claim 1 wherein said connecting rod is connected to said center disk in the radial center of said center disk and centrally between said pair of diaphragms, and said suction valve means is mounted to said housing means, and wherein the space between said pair of diaphragms is open to the atmosphere.

6. A diaphragm chamber as set forth in claim 4 wherein said center disk includes a pair of ring-shaped portions and a connecting portion for interconnecting said ring-shaped portions with a predetermined spacing therebetween, and said connecting rod is pivotally connected to said center disk means through a support shaft mounted on said connecting portion.

7. A diaphragm pump as set forth in claim 6 wherein said drive means comprises a drive shaft rotatably mounted in said housing means.

8. A diaphragm pump as set forth in claim 7 wherein a suction chamber is defined between said diaphragms, said suction valve means is mounted to said center disk means, and the intake port means is formed in said housing means in a manner to be in communication with said suction chamber.

9. A diaphragm pump as set forth in claim 7 wherein said suction valve means is mounted to said housing means, and the space between said pair of diaphragms is open to the atmosphere.

10. A diaphragm pump as set forth in claim 8 wherein said connecting portion of said center disk means includes a pair of plate-like members, and the suction chambers between said pair of diaphragms is supplied with fluid through said intake port means and the gap between said plate-like members.

11. A diaphragm pump as set forth in claim 6 further comprising a parallel motion mechanism for associating said center disk means with said housing means, said mechanism comprising a pair of first stub shafts secured to said center disk in parallel to said support shaft, a pair of second stub shafts secured to an inner wall surface of said housing means in parallel to said pair of first stub shafts, and a pair of levers of equal length each pivotally connected at opposite ends thereof to one of said pair of first stub shafts and one of said pair of second stub shafts, said pairs of first and second stub occupying four vertexes of a parallelogram.

12. A diaphragm pump as set forth in claim 11 wherein said drive means comprises a drive shaft rotatably journalled on said housing means and disposed in parallel to said support shaft.

13. A diaphragm pump as set forth in claim 12 wherein said suction valve means is mounted to said center disk means, and said suction port means is formed in said housing means in a manner to communicate with said suction chamber.

14. A diaphragm pump as set forth in claim 12 wherein said suction valve means is mounted on said housing means, and the space between said pair of diaphragms is open to the atmosphere.

15. A diaphragm pump as set forth in claim 13 wherein said connecting portion of said center disk means includes a pair of plate-like members, and the suction chamber between said pair of diaphragms is supplied with fluid through said suction port and the gap between said plate-like members.

16. A diaphragm pump as set forth in claim 6 further comprising sliding guide means secured to said housing means and adapted to be in sliding contact with said connecting portion of said center disk means to guide the movement of said center disk means to prevent any swinging movement of said center disk means around said support shaft.

17. A diaphragm pump as set forth in claim 16 wherein said drive means comprises an eccentric circular cam or crank rotatably connected to one end of said connecting rod, and a drive shaft connected to one of said eccentric circular cam or crank and rotatably journalled on said housing means.

18. A diaphragm pump as set forth in claim 17 wherein said suction valve means is mounted on said center disk means, a suction chamber is defined between the diaphragms and the intake port means is formed in said housing means in a manner to communicate with said suction chamber.

19. A diaphragm pump as set forth in claim 17 wherein said suction valve means is mounted to said housing means, and the space between said pair of diaphragms is open to the atmosphere.

20. A diaphragm pump as set forth in claim 18 wherein said connecting portion of said center disk means includes a pair of plate-like members, and said suction chamber is supplied with fluid through said intake port means and gap between said plate-like members.

* * * * *